US005848628A

United States Patent [19]

Badalamenti

[11] Patent Number: 5,848,628

[45] Date of Patent: Dec. 15, 1998

[54] DECORATIVE ASSEMBLY FOR WINDOW TREATMENT

[75] Inventor: Rosario Badalamenti, Utica, Mich.

[73] Assignee: F & F Enterprises, Sterling Hts., Mich.

[21] Appl. No.: 891,747

[22] Filed: Jul. 14, 1997

[51] Int. Cl.[6] ..... E04F 10/00

[52] U.S. Cl. ..... 160/38; 211/105.2

[58] Field of Search ..... 160/19, 38, 330, 160/349.2; 211/105.1, 105.2, 106

[56] References Cited

U.S. PATENT DOCUMENTS

| | | | |
|---|---|---|---|
| D. 113,930 | 3/1939 | Lange . | |
| 1,813,556 | 7/1931 | Young . | |
| 2,401,212 | 5/1946 | Wilson . | |
| 2,720,317 | 10/1955 | Stroud | 211/105.2 |
| 2,985,907 | 5/1961 | Duncan | 160/19 |
| 3,111,162 | 11/1963 | Bierlich | 1600/19 |
| 3,537,625 | 11/1970 | Nuttall . | |
| 3,762,097 | 10/1973 | Gallo . | |
| 3,847,314 | 11/1974 | Florian . | |
| 5,074,348 | 12/1991 | Phillips | 160/38 |
| 5,152,331 | 10/1992 | Barone | 160/19 X |
| 5,154,218 | 10/1992 | Subecz | 160/38 X |
| 5,295,595 | 3/1994 | Gobidas et al. . | |
| 5,505,245 | 4/1996 | Badalamenti | 160/38 |

FOREIGN PATENT DOCUMENTS

| | | |
|---|---|---|
| 562950 | 2/1923 | France . |
| 524813 | 5/1940 | United Kingdom . |

*Primary Examiner*—Blair M. Johnson
*Attorney, Agent, or Firm*—Young & Basile, P.C.

[57] ABSTRACT

A decorative assembly for window treatments. The assembly includes a curtain rod and one or more elongated decorative devices. The curtain rod includes a linear main body portion and end portions bent at right angles to the main body portion. Each elongated decorative device includes an elongated foam member having a central axial passage and a ductile wire positioned loosely in the passage. The decorative device is secured to and extends along the elongated main body portion of the rod. The foam member further includes a slit extending the length of the member and interconnecting the exterior of the member to the passage whereby to allow passage of the wire through the slit to position the wire loosely in the passage. The decorative device further includes an elongated fabric sleeve positioned in surrounding relation to the foam member. A plurality of elongated decorative devices are braided together and extend along the main body portion of the rod in intertwisted relation.

12 Claims, 4 Drawing Sheets

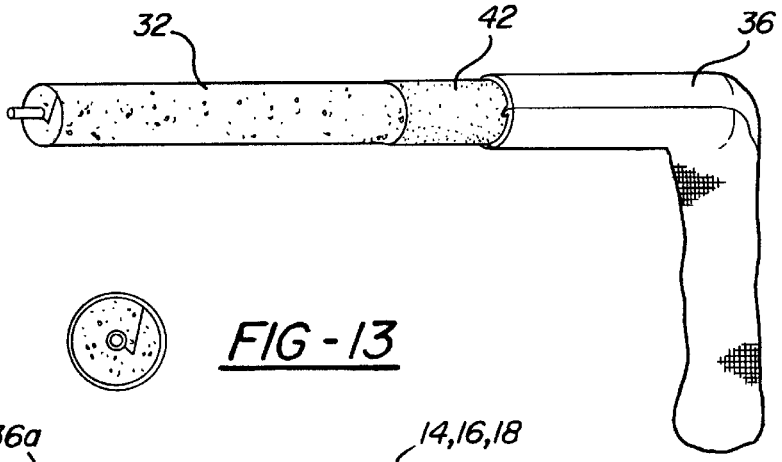
FIG-12
FIG-13
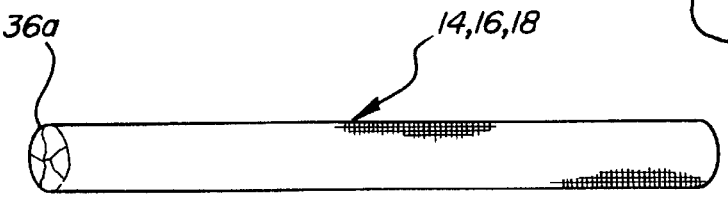
FIG-14
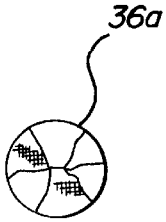
FIG-15
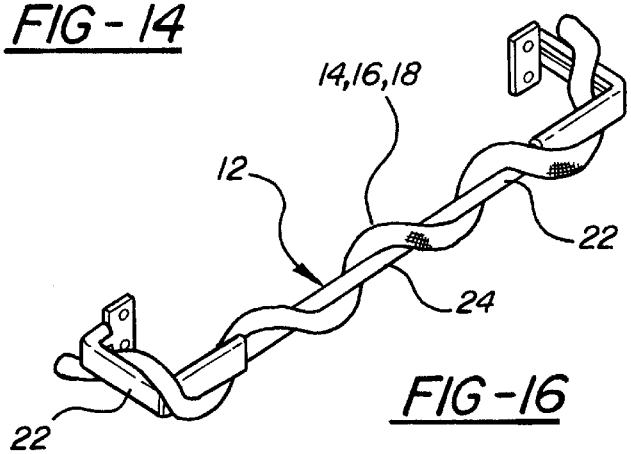
FIG-16
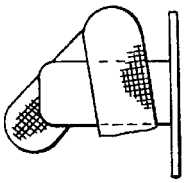
FIG-17
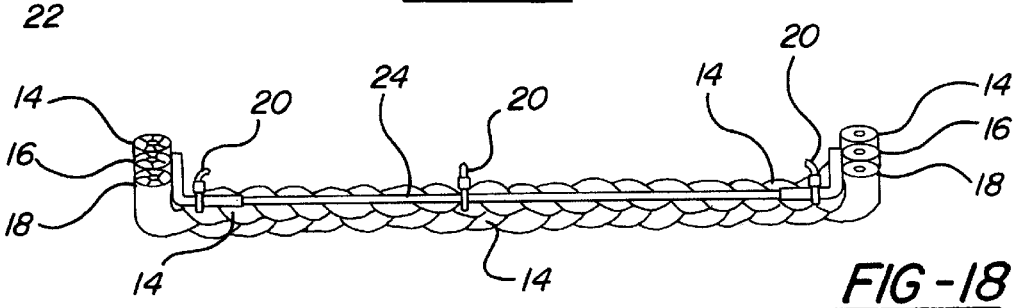
FIG-18
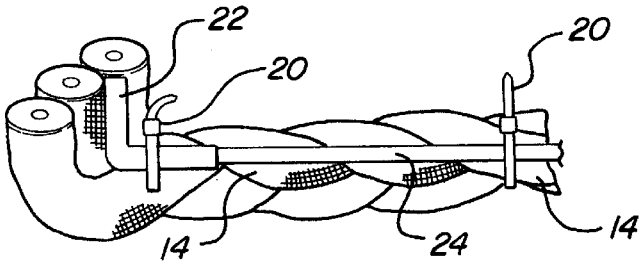
FIG-19

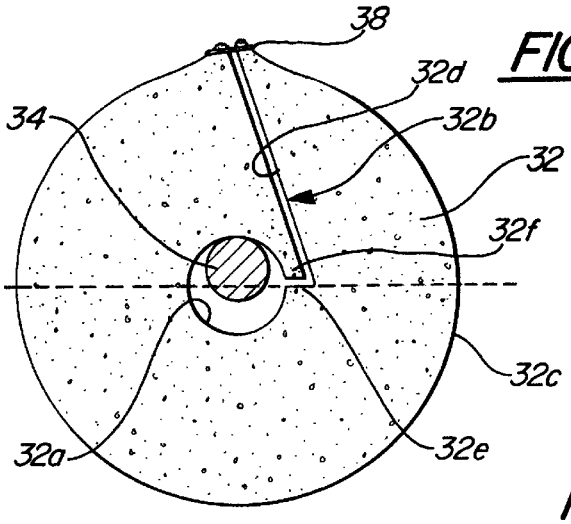
FIG-20
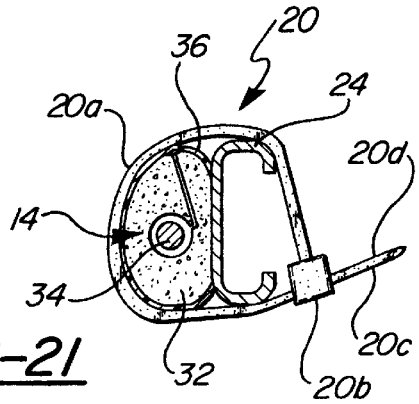
FIG-21
FIG-22
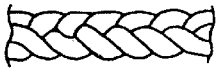
FIG-23
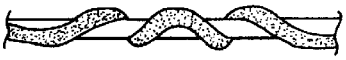
FIG-24
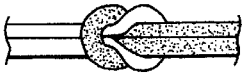
FIG-25
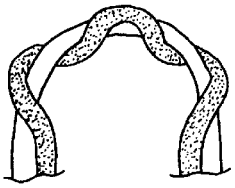
FIG-26
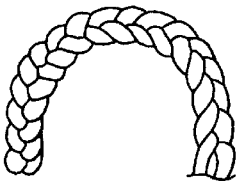
FIG-27
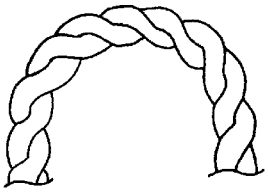
FIG-28
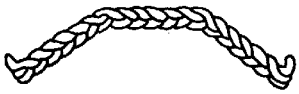
FIG-29
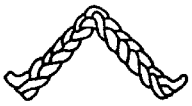

FIG-30
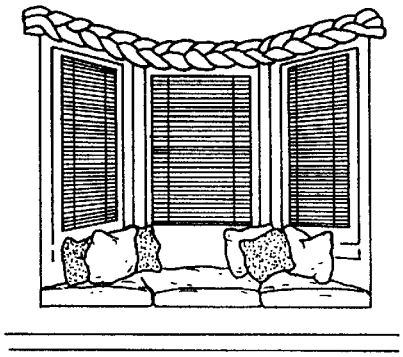
FIG-31
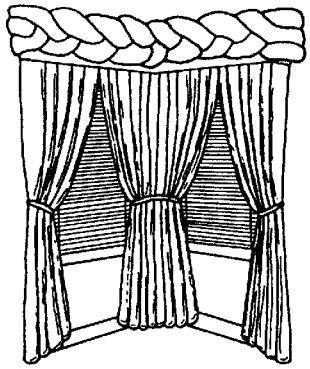
FIG-32
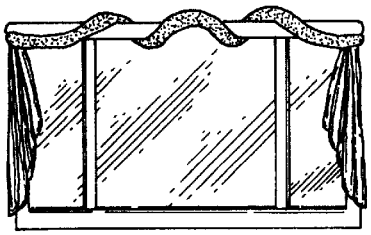
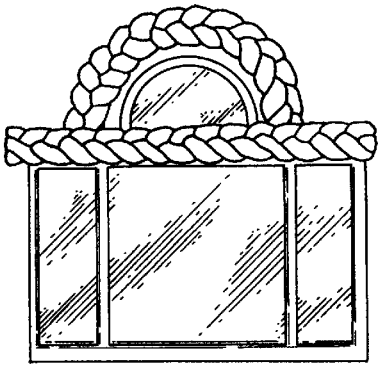
FIG-33
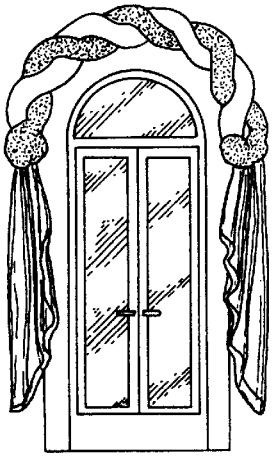
FIG-34

DECORATIVE ASSEMBLY FOR WINDOW TREATMENT

BACKGROUND OF THE INVENTION

This invention relates to decorative assemblies and more particularly to decorative assemblies especially suited for window treatments.

Window treatments are commonly used to enhance the appearance of a window area. Whereas a myriad of window treatment concepts and devices have been proposed and to some extent utilized, there continues to exist a need for a window treatment that is simple in design, inexpensive in construction and amenable to use in association with a wide variety of window shapes and designs.

SUMMARY OF THE INVENTION

This invention is directed to the provision of an improved window treatment.

More specifically, this invention is directed to the provision of a window treatment that is simple in design, inexpensive in construction and amenable to a wide variety of window shapes and designs.

The window treatment of the invention employs an elongated decorative device. The decorative device comprises a ductile wire and an elongated foam member having a central axial passage extending therethrough and having a diameter greater than the diameter of the wire. The foam member further includes a slit extending the length of the member and interconnecting the exterior of the member and the passage. The slit allows passage of the wire through the slit to position the wire loosely in the passage whereby to provide a readily bendable and shapable elongated decorative device for use in formulating a wide variety of window treatments.

According to a further feature of the invention, the elongated decorative device further includes an elongated fabric sleeve positioned in surrounding relation to the foam member. The sleeve allows the elongated decorative device to be provided in a wide variety of appearances depending on the particular decor.

According to a further feature of the invention, the decorative assembly further includes a curtain rod including an elongated main body portion and end portions bent at approximately right angles to the main body portion and means securing the elongated decorative device to the curtain rod with the elongated decorative device extending along the elongated main body portion of the rod. This arrangement allows a curtain rod of standard construction to be utilized in combination with the elongated decorative device of the invention to provide a unique window dressing.

According to a further feature of the invention, the elongated decorative device comprises a first elongated decorative device; the assembly further includes a second elongated decorative device; and the first and second elongated decorative devices are secured to and extend along the main body portion of the rod in intertwisted relation.

In the disclosed embodiment of the invention, the assembly further includes a third elongated decorative device and the first, second, and third elongated decorative devices are secured to and extend along the main body portion of the rod in intertwisted relation. The intertwisted elongated decorative devices, which may include fabric sleeves of varying designs, provide a unique and readily variable window treatment for the associated window area.

BRIEF DESCRIPTION OF THE DRAWINGS

FIG. 12 is a perspective view showing the positioning of the fabric sleeve over the subassembly of FIG. 10;

FIG. 13 is an end view of the subassembly of FIG. 12;

FIG. 14 is a perspective view of a completed elongated decorative device;

FIG. 15 is an end view of the device for FIG. 14;

FIG. 16 is a perspective view showing an elongated decorative device according to the invention in combination with a curtain rod;

FIG. 17 is an end view of the assembly of FIG. 16;

FIG. 18 is a view showing a plurality of elongated decorative devices according to the invention employed in intertwisted fashion in association with a curtain rod;

FIG. 19 is a detail view of the assembly of FIG. 18;

FIG. 20 is a cross-sectional view showing the manner in which the elongated decorative devices are attached to the curtain rod;

FIG. 21 is an enlarged cross-sectional view taken on line 21—21 of FIG. 1; and FIGS. 22–34 are views showing various ways in which elongated decorative devices according to the invention may be employed to create various window dressing decor.

DESCRIPTION OF THE PREFERRED EMBODIMENT

Figure 1:
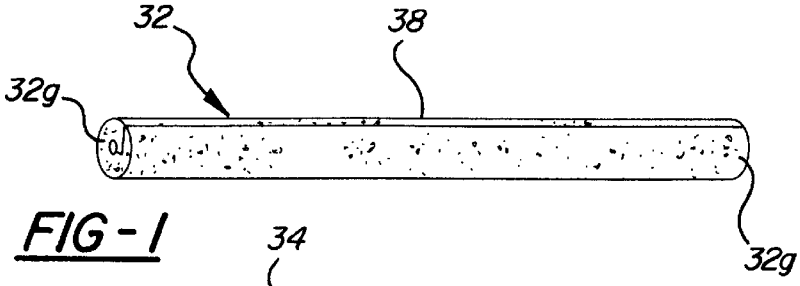
FIG. 1 is a perspective view of a foam member employed in the decorative assembly of the invention.
Figure 2:
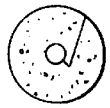
FIG. 2 is an end view of the foam member of FIG. 1.

The decorative assembly 10 of the invention is intended for use in providing decorative treatments and, in particular, in providing decorative treatments in association with window areas.

Decorative assembly 10, broadly considered, includes a curtain rod 12, a plurality of elongated decorative devices 14, 16, and 18, and a plurality of clamps 20.

Curtain rod 12 may be of known form and includes, for example, ends or returns 22 of C-shaped cross-sectional configuration telescopically received over the opposite ends of a linear main body portion 24 also of C-shaped cross-sectional configuration. Returns 22 include end portions 22*a* bent at approximately right angles to main body portion 24 and secured in known manner utilizing brackets 26 to a wall surface 28 in overlying relation to a window assembly 30.

Each of the elongated decorative devices 14, 16, and 18 includes an elongated foam member 32, a ductile wire 34, and a sleeve 36.

Elongated foam member 32 (FIGS. 1 and 21) has a circular cross-sectional configuration and includes a central axial passage 32*a* extending therethrough. Foam member 32 further includes a slit 32*b* extending the length of the member and interconnecting the exterior 32*c* of the member and the passage 32*a*. Binder means in the form, for example, of staples 38 bind the slit together proximate the exterior 32*c* of the foam member. Slit 32*b* has a zigzag configuration in cross-section including a zag portion 32*d* extending obliquely from the exterior of the foam member to a diameter 40 of the foam member and a zig portion 32*e* extending along diameter 40 from the inner end of zag 32*d* to the passage 32*a*. Foam member 32 may be formed, for example, from a block of open cell foam material utilizing a programmed cutting knife.

Figure 3:
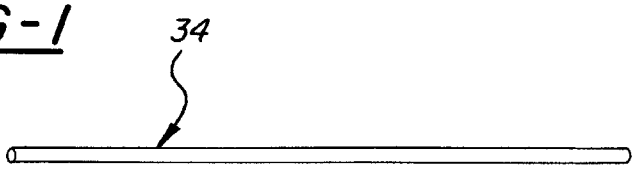
FIG. 3 is a perspective view of a ductile wire employed in the decorative assembly.
Figure 4:
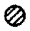
FIG. 4 is an end view of the wire of FIG. 3.

Ductile wire 34 (FIGS. 3, 4, and 21) has a generally circular cross-sectional configuration and has a diameter less than the diameter of foam member central passage 32*a*. Wire 34 may comprise, for example, #6 gauge copper wire.

Sleeve 36 (FIGS. 5, 6, and 12) is formed of any suitable fabric material with confronting longitudinal edges 36*a* of the fabric suitably joined together as by stitching 40. Sleeve 36 has a diameter slightly greater than the diameter of foam member 32.

To assemble an elongated decorative device 14, 16, or 18, (FIGS. 10–15) wire 34 is passed inwardly through zag portion 32*d* of slit 32*b* and thereafter passed radially inwardly through the zig portion 32*e* of the slit to allow the wire to enter central axial passage 32*a*. Due to the oversized nature of the passage 32*a* relative to the diameter of wire 34, the wire is positioned loosely within the passage and due to the zig-zag, offset configuration of slit 32*b*, the wire tends to be contained within passage 32*a* by a tail portion 32*f* of the foam member formed by zig portion 32*e* in cooperation with the inner end of zag portion 32*d*. Following the positioning of wire 34 within passage 32*a*, staples 38 are utilized to bind the slit 32*b* together proximate the exterior 32*c* of the foam member whereby to preclude inadvertent escape of the rod.

Following the stitching operation, sleeve 36 is pulled over foam member 32, as best seen in FIG. 12. Sleeve 36 may be pulled directly over foam member 32 or, to facilitate the movement of the sleeve over the foam member, a clear plastic sleeve 42 may first be positioned over the foam member 32 to provide lubricity as between the sleeve and the foam member to facilitate mounting of the sleeve on the foam member.

Following movement of the sleeve 36 to a position enveloping the foam member, and with end portions 36*a* of the sleeve overlapping and extending axially beyond the opposite ends 32*g* of the foam member, the overlapping end portions 36*a* may be folded over the respective ends of the foam member in the manner of a package whereafter the folded over end portions of the sleeve may be secured together and secured to the respective end 32*g* of the foam member utilizing a hot glue gun or the like. A completed elongated decorative device 14, 16, 18 is seen in FIG. 14.

In one form of the invention, an elongated decorative device 14, 16, 18 may be wrapped around curtain rod 12 in serpentine fashion, as seen in FIG. 16, to provide a decorative assembly for use in association with a window area. In a preferred form of the invention decorative assembly, and as seen in FIGS. 18 and 19, decorative devices 14, 16, and 18 are twisted together to form a braided construction and the braided construction is secured to the curtain rod with the braided construction extending along the elongated main body portion of the curtain rod and thereafter wrapping around the ends or returns of the curtain rod.

The braided, intertwisted structure is secured to the curtain rod utilizing clamps 20. Clamps 20 are of known form and include a band portion 20*a* and a lock portion 20*b* at one end of the band portion defining a slot to receive the other, free end 20*c* of the band portion. The lock portion 20*b* defines a ratchet structure which coacts with ratchet teeth 20*d* on the free end 20*c* of the band as the band is passed through the slot in the lock portion to irreversibly lock the band 20*c* in any position to which it is pulled through the slot. Bands 20 may, for example, as seen in FIG. 20, wrap around curtain rod 12 and around decorative device 14 in a plurality of axially spaced locations along the curtain rod so that the decorative device 14 is held to the curtain rod by the clamps and the decorative devices 16 and 18 are held in position by their braided intertwisted relationship with respect to device 14.

Figure 5:
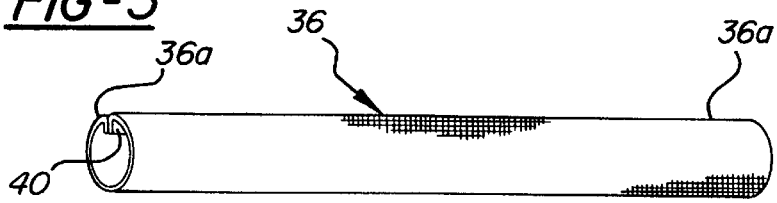
FIG. 5 is a perspective view of a fabric sleeve employed in the decorative assembly.
Figure 6:
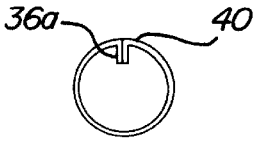
FIG. 6 is an end view of the fabric sleeve of FIG. 5.
Figure 7:
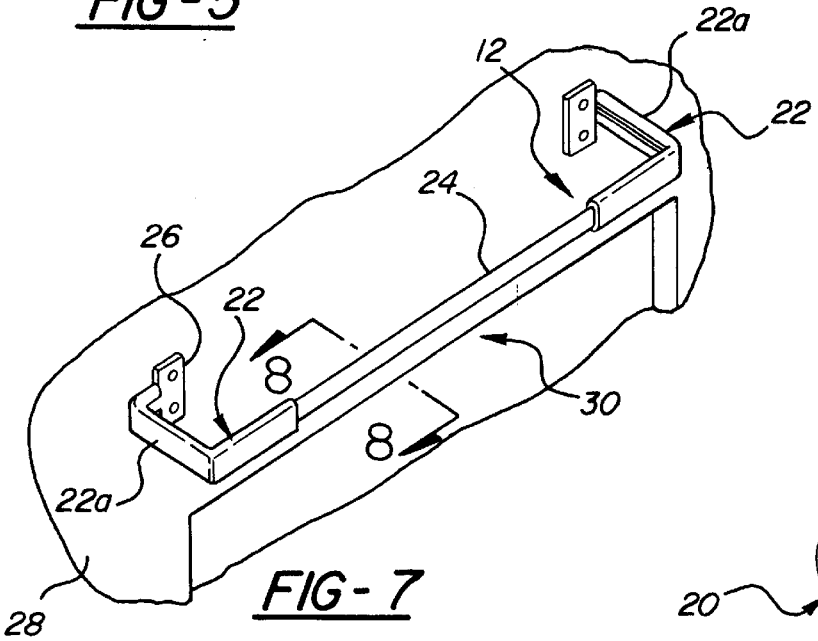
FIG. 7 is a perspective view of a curtain rod employed in the decorative assembly.
Figure 8:
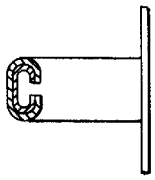
FIG. 8 is a cross-sectional view taken on line 8—8 of FIG. 7.
Figure 9:
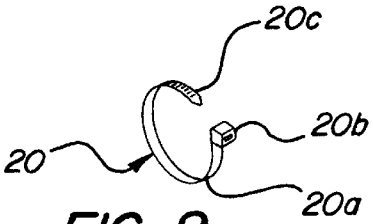
FIG. 9 is a view of clamps employed in the decorative assembly.
Figure 10:
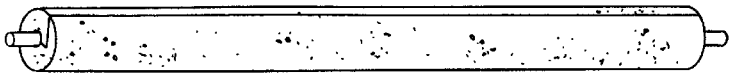
FIG. 10 is a perspective view showing a subassembly of the elongated foam member at the ductile wire.
Figure 11:
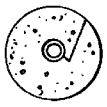
FIG. 11 is an end view of the subassembly of FIG. 10.

The ductile wire 34 of each decorative device, in combination with the resiliency of the foam member, enables each device to be selectively twisted and braided to form the intertwisted structure extending along the main body of the curtain rod and further allows the decorative devices to be bent at their ends through right angles to allow the devices to be positioned outside of and along the curtain rod return 22*a* so that the braided structure when installed on the curtain rod totally conceals the curtain rod. The decorative effect of the total assembly is thus the braided effect created by the intertwisted decorative devices 14, 16, and 18. The sleeves of the decorative devices may, of course, be given any pattern or color so as to create a desired overall decorative effect. For example, sleeve 36 may have a solid color as seen in FIG. 5 or may have a pattern as seen in FIG. 14. Thus, when braided together as seen in FIG. 18, the overall effect may comprise a pattern intertwined with solid colors.

Although the elongated decorative devices of the invention have thus far been described as forming a decorative assembly in cooperation with a curtain rod, the decorative devices may also be used without the curtain rod to create desired decorative effects. Several examples of the manner in which a plurality of decorative devices 14, 16, and 18 may be combined to form decorative effects for various window treatments are seen in FIGS. 22–34. For example, the separate decorative devices may be braided together as seen in FIG. 22, twisted together as seen in FIG. 23, or knotted together as seen in FIG. 24. Further, the decorative devices may be intertwisted in various ways to form arch constructions as seen in FIGS. 25, 26, and 27; to form a bay window construction as seen in FIG. 28; or to form a corner window construction as seen in FIG. 29. Further, the decorative devices may be used in combination with further window decorative devices to create the overall window treatment appearances seen in FIGS. 30–34.

The invention will be seen to provide a decorative assembly which is simple in construction, inexpensive in design, and amenable for use in association with a wide variety of window shapes and designs.

Whereas a preferred embodiment of the invention has been illustrated and described in detail, it will be apparent that various changes may be made in the disclosed embodiment without departing from the scope or spirit of the invention.

What is claimed is:

1. A decorative assembly for window treatment or the like including an elongated decorative device comprising:

a ductile wire;

an elongated foam member having a central axial passage extending therethrough and a slit extending the length of the member and interconnecting the exterior of the member and the passage whereby to allow passage of the wire through the slit to position the wire loosely in the passage; and an elongated fabric sleeve positioned in surrounding relation to the foam member and having a length exceeding the length of the wire and the foam member so as to define opposite sleeve end portions extending axially beyond the opposite ends of the wire and the foam member; and means maintaining the opposite end portions of the sleeve in folded over disposition against the respective ends of the wire and the foam member whereby to totally enclose the wire and the foam member.

2. A decorative assembly according to claim 1 wherein the assembly further includes:

a curtain rod including an elongated main body portion and end portions bent at approximately right angles to the main body portion; and means securing the elongated decorative device to the curtain rod with the elongated decorative device extending along the elongated main body portion of the curtain rod.

3. A decorative assembly for window treatment or the like including an elongated decorative device comprising:

a ductile wire; and an elongated foam member having a central axial passage extending therethrough and having a diameter greater than the diameter of the wire, the foam member further including a slit extending the length of the member and interconnecting the exterior of the member and the passage whereby to allow passage of the wire through the slit to position the wire loosely in the passage.

4. A decorative assembly according to claim 3 wherein the wire and foam member have corresponding lengths and the elongated decorative device further includes an elongated fabric sleeve positioned in surrounding relation to the foam member and having a length exceeding the length of the wire and foam member so as to define opposite sleeve end portions extending axially beyond the opposite ends of the wire and the foam member, the opposite end portions of the sleeve being folded over against the respective ends of the wire and the foam member to totally enclose the wire and the foam member.

5. A decorative assembly according to claim 3 wherein the decorative device further includes binder means binding the slit together proximate the exterior of the member whereby to preclude exit of the wire from the passage following positioning of the wire in the passage.

6. A decorative assembly including:

a curtain rod having an elongated linear main body portion and end portions bent at right angles to the main body portion;

an elongated decorative device including an elongated foam member having a central axial passage, an elongated ductile wire positioned in the passage, and an elongated tubular fabric sleeve positioned over the foam member; and means securing the decorative device to the curtain rod with the elongated decorative device extending along and against the elongated main body portion of the rod.

7. A decorative assembly for window treatment or the like including:

first and second elongated decorative devices, each decorative device including a ductile wire, an elongated foam member having a central axial passage extending therethrough and a slit extending the length of the member and interconnecting the exterior of the member and the passage whereby to allow passage of the wire through the slit to position the wire loosely in the passage, and an elongated fabric sleeve positioned in surrounding relation to the foam member;

a curtain rod including an elongated main body portion and end portions bent at approximately right angles to the main body portion; and means securing the elongated first and second decorative devices to the curtain rod with the elongated decorative devices extending along the elongated main body portion of the curtain rod in intertwisted relation.

8. A decorative assembly according to claim 7 wherein:

the assembly further includes a third elongated decorative device as described; and the first, second, and third elongated decorative devices are secured to and extend along the main body portion of the rod in intertwisted relation.

9. A decorative assembly including:

a curtain rod having an elongated linear main body portion and end portions bent at right angles to the main body portion;

an elongated decorative device including an elongated foam member having a central axial passage and a ductile wire positioned in the passage; and means securing the decorative device to the curtain rod with the elongated decorative device extending along the elongated main body portion of the rod in twisted fashion.

10. A decorative assembly according to claim 9 wherein:

the elongated decorative device comprises a first elongated decorative device;

the assembly further includes a second elongated decorative device; and the first and second elongated decorative devices are secured to and extend along the main body portion of the rod in intertwisted relation.

11. A decorative assembly for window treatment or the like including an elongated decorative device comprising:

a ductile wire; and an elongated foam member having a central axial passage extending therethrough and having a diameter greater than the diameter of the wire, the foam member further including a slit extending the length of the member and interconnecting the exterior of the member and the passage whereby to allow passage of the wire through the slit to position the wire loosely in the passage, the slit having a zig-zag configuration to allow entry of the wire into the passage but discourage exit of the wire from the passage.

12. A decorative assembly according to claim 11 wherein the slit includes a zag portion extending from the exterior of the fabric member to an inner end located within the member but outside of the passage, and a zig portion extending from the inner end of the zag portion to the passage.

* * * * *